US010421631B1

(12) United States Patent
Johnson et al.

(10) Patent No.: US 10,421,631 B1
(45) Date of Patent: Sep. 24, 2019

(54) PLATFORM OF CELLULAR OMNI WHEELS FOR A REGISTRATION SYSTEM

(71) Applicant: Xerox Corporation, Norwalk, CT (US)

(72) Inventors: D. Clay Johnson, Rochester, NY (US); Timothy P. Foley, Marion, NY (US); Eliud Robles Flores, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/948,391

(22) Filed: Apr. 9, 2018

(51) Int. Cl.

| | |
|---|---|
| ***B65H 9/02*** | (2006.01) |
| ***B65H 9/00*** | (2006.01) |
| ***B41J 11/00*** | (2006.01) |
| ***B65H 5/06*** | (2006.01) |
| ***B41J 13/03*** | (2006.01) |
| ***B41J 13/076*** | (2006.01) |
| ***B65H 9/20*** | (2006.01) |
| ***B41J 13/00*** | (2006.01) |

(52) U.S. Cl.
CPC ..... *B65H 9/002* (2013.01); *B41J 11/0055* (2013.01); *B41J 11/0095* (2013.01); *B41J 13/0018* (2013.01); *B41J 13/03* (2013.01); *B41J 13/076* (2013.01); *B65H 5/062* (2013.01); *B65H 9/20* (2013.01)

(58) Field of Classification Search
CPC ..... B65H 9/002; B65H 9/16; B65H 9/166; B65H 9/20
See application file for complete search history.

(56) References Cited

U.S. PATENT DOCUMENTS

| | | | | |
|---|---|---|---|---|
| 5,065,998 | A * | 11/1991 | Salomon | B65H 9/166 198/456 |
| 6,059,284 | A * | 5/2000 | Wolf | B65H 5/062 271/227 |
| 6,554,276 | B2 * | 4/2003 | Jackson | B65H 15/00 271/186 |
| 8,567,587 | B2 * | 10/2013 | Faist | B65G 1/0478 198/370.09 |
| 9,156,642 | B2 * | 10/2015 | Dunham | G03G 15/6582 |
| 9,422,127 | B2 * | 8/2016 | Terrero | B65H 9/101 |
| 9,758,330 | B2 * | 9/2017 | Park | B65H 5/06 |
| 2008/0179826 | A1 * | 7/2008 | Gregoire | B65G 13/10 271/264 |

FOREIGN PATENT DOCUMENTS

| | | | | |
|---|---|---|---|---|
| WO | WO-2014012861 | A1 * | 1/2014 | B65G 39/12 |

OTHER PUBLICATIONS

English translation (Google Patents) of WO2014/012861 Al.*

* cited by examiner

*Primary Examiner* — Ernesto A Suarez

(57) ABSTRACT

A registration system for a printing device and a method for controlling the same are disclosed. For example, the registration system includes at least one sensor to detect a position of a print media, a platform comprising a plurality of cellular omni wheels, and a processor communicatively coupled to the at least one sensor and the plurality of cellular omni wheels, wherein the processor calculates a desired movement of each one of the plurality of cellular omni wheels based on the position of the print media.

10 Claims, 5 Drawing Sheets

PLATFORM OF CELLULAR OMNI WHEELS FOR A REGISTRATION SYSTEM

The present disclosure relates generally to printing devices and, more particularly, to a platform of cellular omni wheels for a registration system within a printing device.

BACKGROUND

Printing devices can be used to print images on print media. The print media can be fed through the printing device along a transport path and imaging path to have the image printed. Along the transport path and the imaging path, there are certain locations where processing errors can occur that can cause a misalignment of the image relative to the print media.

For example, the printing devices can have a registration system. The registration system may be responsible for correctly feeding the print media to an imaging system such that the printed image is correctly aligned with the print media. As the size and weight of print media grows larger and larger, it can be more and more difficult for currently designed registration systems to handle the larger print media.

SUMMARY

According to aspects illustrated herein, there are provided a registration system for a printing device and a method for controlling the same. One disclosed feature of the embodiments is a registration system for a printing device comprising at least one sensor to detect a position of a print media, a platform comprising a plurality of cellular omni wheels, and a processor communicatively coupled to the at least one sensor and the plurality of cellular omni wheels, wherein the processor calculates a desired movement of each one of the plurality of cellular omni wheels based on the position of the print media.

Another disclosed feature of the embodiments is a method for controlling a position of a print media in a registration system of a printing device. In one embodiment, the method detects a position of a print media via at least one sensor, determines a desired movement of at least one omni wheel coupled to each one of the plurality of cellular omni wheels based on the position of the print media, and moves the at least one omni wheel coupled to the each one of the plurality of cellular omni wheels in accordance with the desired movement to adjust the position of the print media.

BRIEF DESCRIPTION OF THE DRAWINGS

The teaching of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

The present disclosure is related to a platform of cellular omni wheels for a registration system and a method for registering a print media using the platform of cellular omni wheels. As discussed above, print devices can have a registration system. The registration system may be responsible for correctly feeding the print media to an imaging system such that the printed image is correctly aligned with the print media. As the size and weight of print media grows larger and larger, it can be more and more difficult for currently designed registration systems to handle the larger print media.

Registration systems may include center registered systems and edge registered systems. Current designs for some registration systems require the use of three nips and/or a movable registration carriage. The movable registration carriage may help adjust for lateral input error.

A center nip may be vertically movable (e.g., up and down). As a result, for smaller sheets of print media, the center nip may be moved down to engage the print media. For larger sheets of print media, the center nip may be moved up to disengage the print media and allow the outer two nips to engage the print media. However, if a sheet of print media that is sized between the smallest sheet and the largest sheet is received, the registration system may have difficulty handling the print media.

In addition, the nips in the previously designed registration system may be spaced to handle the smallest sized print media. However, this may cause one of the nips to be located more towards a center of along a width of the paper path or both nips may be located offset to one side of the paper path. When the nips are in fixed locations, and a sheet that is smaller than the largest expected size and larger than the smallest expected size of print media is received, the location of the nips may not be ideal for aligning the print media.

Embodiments of the present disclosure provide a registration system that uses a platform of omni wheels to correct various alignment errors, such as lateral input errors, skew, and the like. The omni wheels provide greater directional control of the print media within the registration system. For example, the nips and the movable registration carriage may be replaced with the omni wheels. The omni wheels may provide skew correction and lateral position correction.

Figure 1:
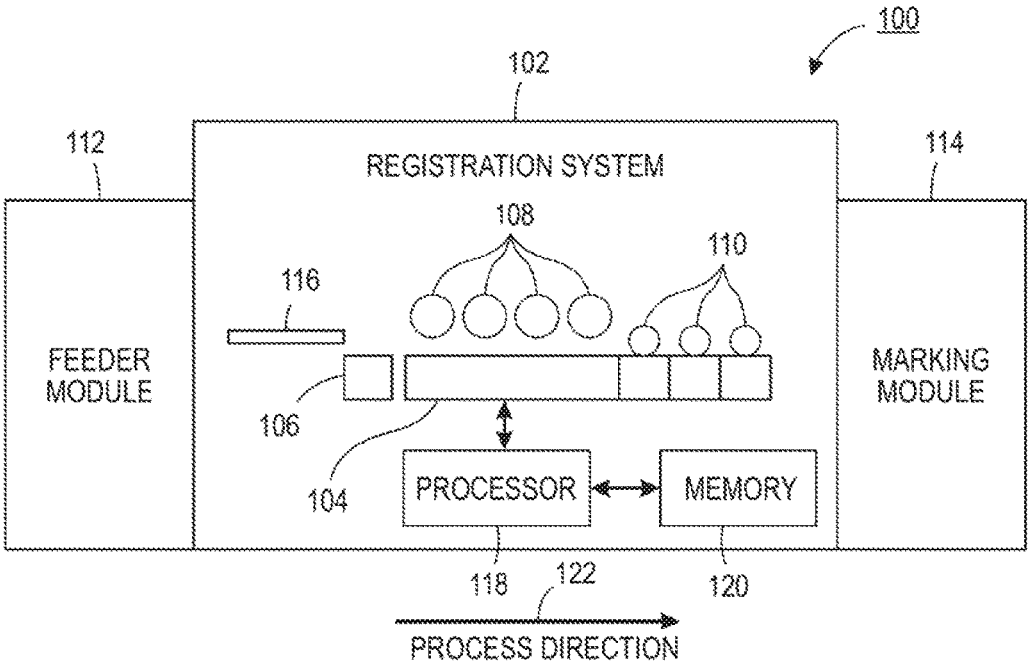
FIG. 1 illustrates a block diagram of example printing device of the present disclosure.

FIG. 1 illustrates a block diagram of an example printing device 100 of the present disclosure. The printing device 100 may be any type of printing device such as a multi-function device (MFD), a copy machine, laser printer, an ink jet printer, and the like.

In one embodiment, the printing device 100 may include a feeder module 112, a registration system 102, and a marking module 114. It should be noted that the printing device 100 has been simplified for ease of explanation. The printing device 100 may include additional components and modules that are not shown. For example, the printing device 100 may include a finishing module, print heads, a duplex paper path, a digital front end, a graphical user interface (GUI), and the like.

In one embodiment, the feeder module 112 may include feeder trays that feed a print media 116 through the printing device 100. The print media 116 may be any type of print media such as paper, card stock, and the like, and have any dimensions. In one embodiment, the printing device 100 of the present disclosure may be designed to handle print media 116 with high aspect ratios or very long lengths (e.g., 40 inches or longer). The feeder module 112 may feed the print media 116 to a registration system 102.

In one embodiment, the registration system 102 may include a platform 104 of a plurality of cellular omni wheels, at least one sensor 106, and one or more additional transport nips 110. The sensor 106 may be located upstream from the platform 104. The sensor 106 may be any type of sensor that can detect a position of the print media 116. For example, the sensor 106 may be a charged coupled device (CCD) sensor, a capacitive sensor, a resistive sensor, an image based sensor, and the like.

The position detected by the sensor 106 may include a skew and a lateral position of the print media 116. The skew may measure an amount of tilt, or angle, in an inboard or an outboard direction relative to a line that is parallel to a process direction 122. In other words, zero skew may mean that both sides of the leading edge of the print media 116 would reach the sensor 106 simultaneously. If there is skew, one side (e.g., the left side) of the leading edge may reach the sensor 106 before the other side (e.g., the right side) of the leading edge reaches the sensor 106.

The lateral position may detect an amount a distance from a desired alignment position. For example, if the printing device 100 is a center registered device, then the lateral position may measure a distance that a center of the print media 116 is away from a center of the registration system 102. In another example, if the printing device 100 is an edge registered device, then the lateral position may measure a distance that an edge of the print media 116 is from a registration edge of the registration system 102.

In one embodiment, the registration system 102 may include a processor 118 and a memory 120. The processor 118 may be communicatively coupled to the cellular omni wheels (shown in FIGS. 2-4 and discussed in further details below) of the platform 104, the sensor 106, and the memory 120. The position of the print media 116 detected by the sensor 106 may be transmitted to the processor 118. The processor 118 may then control omni wheels of one or more of the cellular omni wheels of the platform 104 by a desired amount to adjust the position of the print media 116 into a correct position.

In one embodiment, the memory 120 may store instructions that are executed by the processor 118 to perform the adjustment or to control the omni wheels by the desired amount. The memory 120 may also store data used by the processor 118 to perform the calculations to determine the desired amount of movement of the omni wheels of one or more of the cellular omni wheels of the platform 104.

In one embodiment, the registration system 102 may also include one or more idler rollers 108. The one or more idler rollers 108 may be located over the platform 104 or opposite the platform 104. The idler rollers 108 may be cylindrical or spherical in shape and roll freely. The idler rollers 108 may help to keep the print media 116 flat against the platform 104.

In one embodiment, the transport nips 110 may located downstream from the platform 104. The transport nips 110 may move the print media 116 after the print media 116 is correctly aligned to the desired alignment position towards the marking module 114. In one embodiment, the marking module 114 may print a desired image onto the print media 116. The marking module 114 may use any type of printing means to print the desired image. For example, the marking module 114 may include an imaging belt that transfers toner that is dispensed onto the imaging belt onto the print media 116. In another example, the marking module 114 may include ink jet print heads that print a desired image onto the print media 116, and the like.

A finishing module (not shown) may perform any final processing of the print media after the desired image is printed. For example, the final processing may include, stacking, stapling, collating, organizing, and the like, the print media with the desired printed image.

Figure 2:
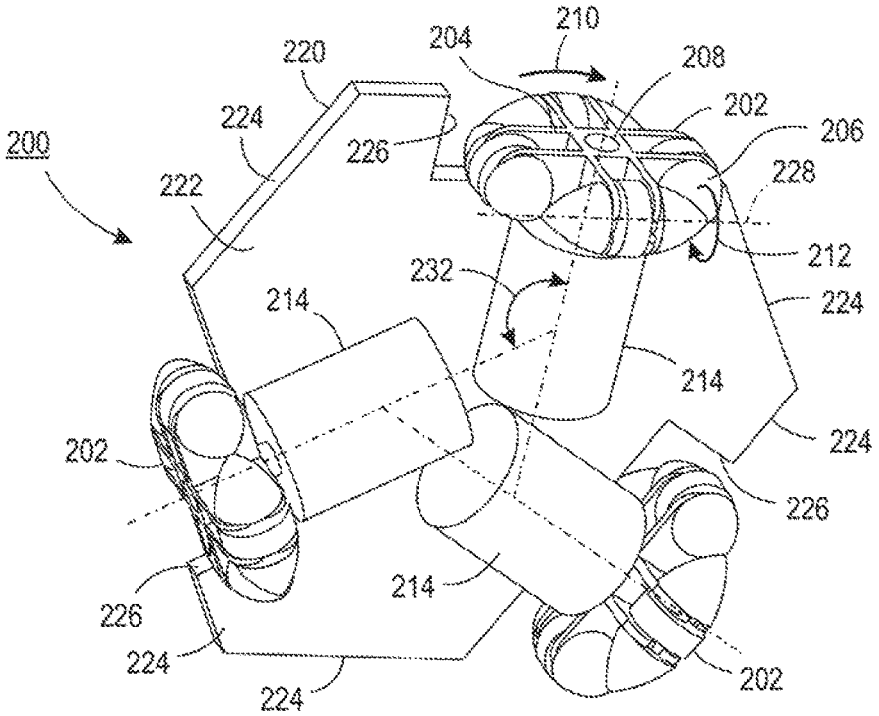
FIG. 2 illustrates a bottom isometric view of an example cellular omni wheel of the present disclosure.
Figure 3:
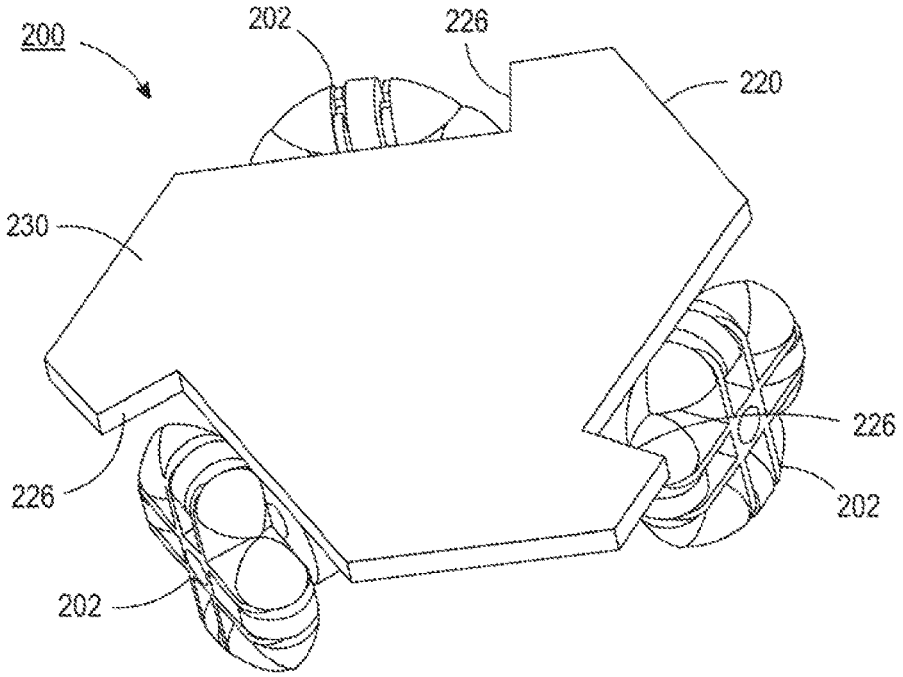
FIG. 3 illustrates a top isometric view of an example cellular omni wheel of the present disclosure.

FIGS. 2 and 3 illustrate a bottom isometric view and a top isometric view, respectively, of an example cellular omni wheel 200 of the platform 104. Referring to FIG. 2, in one embodiment, the cellular omni wheel 200 may include a plurality of omni wheels 202. In one embodiment, the cellular omni wheel 200 may include three omni wheels 202, but it should be noted that each cellular omni wheel 200 may include any number of omni wheels 202.

In one embodiment, all of the cellular omni wheels 200 may have the same number of omni wheels 202. In another embodiment, different subsets of the cellular omni wheels 200 of the platform 104 may include different numbers of omni wheels 202.

In one embodiment, each omni wheel 202 may include a central body portion 204. The central body portion 204 may rotate around a central axis or central axis of rotation 208, as shown by an arrow 210. In addition, each omni wheel 202 may also include a plurality of roller components 206 coupled to an outer periphery of the central body portion 204. Each one of the plurality of roller components 206 may rotate around an axis that is perpendicular to the respective center axis 208. For example, if the omni wheel 202 rotates around the center axis 208, the plurality of roller components 206 may rotate around an axis, or axis of rotation 228 that is perpendicular to the center axis 208 as shown by an arrow 212.

In other words, FIG. 2 illustrates an omni wheel 202 with four sets of roller components 206. Each one of the four roller components 206 may rotate, as shown by the arrow 212, around its respective axis of rotation 228 that are all also perpendicular to the center axis 208.

In one embodiment, the plurality of roller components 206 may have a cylindrical, a rounded cylindrical, or a spherical like shape and freely rotate in a direction as shown by the arrow 212. The plurality of roller components 206 may be spaced evenly apart around the outer periphery of the central body portion 204.

In one embodiment, the central body portion 204 and the plurality of roller components 206 may be comprised of any type of material. In one example, the central body portion 204 and the plurality of roller components 206 may be fabricated from a plastic or a rubber type material.

In one embodiment, each one of the omni wheels 202 may be coupled to a bottom side 222 of a body portion 220. In one embodiment, the omni wheels 202 may be symmetrically arranged around the bottom side 222. For example, if three omni wheels 202 are coupled to the bottom side 222, then the omni wheels 202 may be arranged at an angle 232 of 120 degrees.

In one embodiment, each one of the omni wheels 202 may be coupled to a motor 214. The motor 214 may also be communicatively coupled to the processor 118. Thus, the processor 118 may control operation of the motor 214.

As noted above, the processor 118 may calculate a desired movement of the omni wheels 202 based on the position of the print media 116. In one embodiment, the desired movement may include a speed of rotation of the omni wheels 202. The speed of rotation of the omni wheels 202 may be controlled by operation of the motor 214. The speed of rotation of the omni wheels 202 and different speeds of rotation for different omni wheels can be used to adjust a skew and/or a lateral position of the print media 116, as discussed in further details below.

In one embodiment, the body portion 220 may be fabricated from a plastic or a metal. The body portion 220 may be any polygon shape that can be arranged in a cellular fashion to form the platform 104. In one embodiment, the body portion 220 may have a symmetrical shape. For example, if three omni wheels are used, then the body portion 220 may have a hexagonal shape.

In one embodiment, the edges 224 of the body portion 220 may have a cut-out 226 along every other edge 224 of an outer perimeter of the body portion 220. In one embodiment, the dimensions of the cut-out 226 may be approximately equal to a diameter and thickness of each omni wheel 202. In one embodiment, each surface of the edge 224 that does not have a cut-out 226 may be used as a connection edge to couple to another connection edge of other cellular omni wheels 200 to form the platform 104.

FIG. 3 illustrates a top isometric view of the cellular omni wheel 200. The body portion 220 may include a flat top surface 230. The cut-outs 226 may allow a portion of the omni wheel 202 to extend above the flat top surface 230 of the body portion 220. As a result, as the print media 116 travels over the flat top surface 230, the omni wheels 202 may contact the print media 116 and move the print media 116 as controlled by the processor 118.

Figure 4:
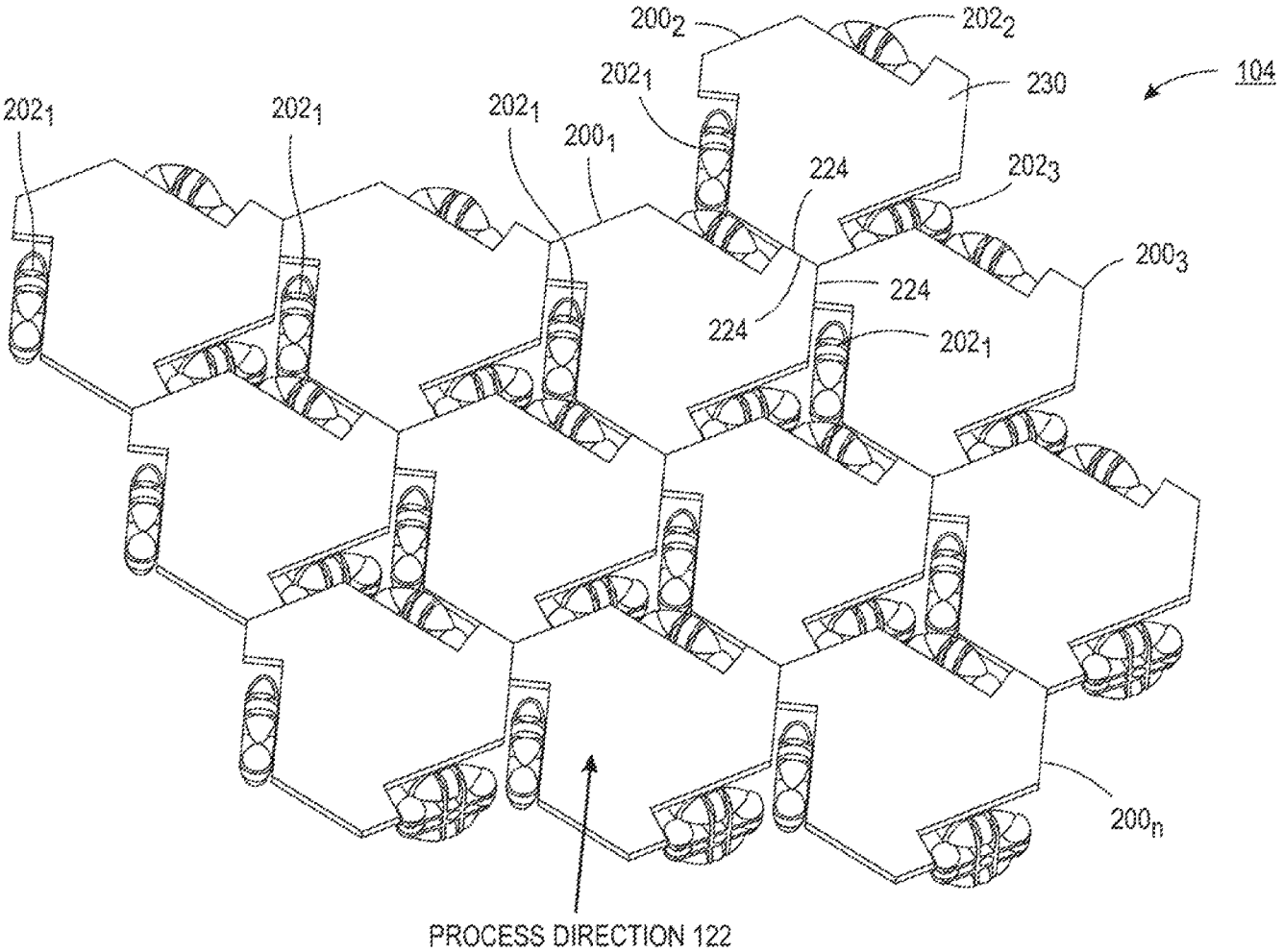
FIG. 4 illustrates a top isometric view of an example platform of a plurality of cellular omni wheels of the present disclosure.

FIG. 4 illustrates a top view of an example of the platform 104 of the plurality of omni wheels 200. FIG. 4 illustrates an arrangement of cellular omni wheels $\mathbf{200}_1$ to $\mathbf{200}_n$. The cellular omni wheels 200 may be coupled to one another along surfaces (also referred to as connection edges) of the edges 224 that do not have a cut-out. In one embodiment, the cellular omni wheels 200 may be coupled via a mechanical fastener (e.g., a bracket and screw) on the bottom side 222 of the body portion 220, via gluing the surfaces, via soldering, or any other coupling means.

The example illustrated in FIG. 4 illustrates the cellular omni wheels 200 having three omni wheels $\mathbf{202}_1$, $\mathbf{202}_2$, and $\mathbf{202}_3$. However, as noted above, the cellular omni wheels may have any number of omni wheels. In one embodiment, one of the omni wheels (e.g., the omni wheel $\mathbf{202}_1$) of each one of the cellular omni wheels $\mathbf{200}_1$ to $\mathbf{200}_n$ may be aligned along the process direction 122. As a result, the omni wheel $\mathbf{202}_1$ of each one of the cellular omni wheels $\mathbf{200}_1$ to $\mathbf{200}_n$ may provide a forward drive of print media 116.

The omni wheels $\mathbf{202}_2$ and $\mathbf{202}_3$ may be angled and be controlled to adjust a skew and/or a lateral position of the print media 116. For example, operating the omni wheels $\mathbf{202}_2$ of each one of the cellular omni wheels $\mathbf{200}_1$ to $\mathbf{200}_n$ may move the print media 116 in a first lateral direction (e.g., inboard) and operating the omni wheels $\mathbf{202}_3$ of each one of the cellular omni wheels $\mathbf{200}_1$ to $\mathbf{200}_n$ may move the print media 116 in a second lateral direction (e.g., outboard).

In one embodiment, operating omni wheels $\mathbf{202}_2$ and $\mathbf{202}_3$ of the cellular omni wheels $\mathbf{200}_1$ to $\mathbf{200}_n$ at the same time, but at different rotational speeds, may adjust a skew of the print media 116. In one embodiment, operating omni wheels $\mathbf{202}_2$ and $\mathbf{202}_3$ of the cellular omni wheels $\mathbf{200}_1$ to $\mathbf{200}_n$ at the same time, but at different rotational speeds may adjust the skew and the lateral position simultaneously.

In one embodiment, the processor 118 may control operation of the omni wheels $\mathbf{202}_1$, $\mathbf{202}_2$, and $\mathbf{202}_3$ of each one of the cellular omni wheels $\mathbf{200}_1$ to $\mathbf{200}_n$ at the same time. In other words, the rotational speed of the omni wheel $\mathbf{202}_1$ of each one of the cellular omni wheels $\mathbf{200}_1$ to $\mathbf{200}_n$ may be the same and activated at the same time.

In one embodiment, the processor 118 may control the omni wheel $\mathbf{202}_2$ of different cellular omni wheels $\mathbf{200}_1$ to $\mathbf{200}_n$ at different speeds. For example, the omni wheel $\mathbf{202}_2$ of the cellular omni wheel $\mathbf{200}_1$ may have a higher speed of rotation than the omni wheel $\mathbf{202}_2$ of the cellular omni wheel $\mathbf{200}_2$.

In one embodiment, the processor 118 may control the omni wheels $\mathbf{202}_1$, $\mathbf{202}_2$, and $\mathbf{202}_3$ of the cellular omni wheels $\mathbf{200}_1$ to $\mathbf{200}_n$ at different times. For example, the first row of cellular omni wheels 200 may be activated as the print media 116 moves over them. The processor 118 may control the omni wheels $\mathbf{202}_1$, $\mathbf{202}_2$, and $\mathbf{202}_3$ of the first row of cellular omni wheels 200 at a different rotational speeds based on the desired movement.

As the print media 116 travels over the next row of cellular omni wheels 200, the omni wheels $\mathbf{202}_1$, $\mathbf{202}_2$, and $\mathbf{202}_3$ of the next row of cellular omni wheels 200 may be activated and the first row of cellular omni wheels 200 may be deactivated. Thus, different subsets of omni wheels 200 may be activated and deactivated by the processor 118 as the print media 116 travels across the platform 104 of the plurality of cellular omni wheels 200. The subsets may be organized in groups other than rows. For example, the subset may include a cluster of cellular omni wheels 200 at a particular location (e.g., an upper right hand portion of the print media 116) to increase the speed of skew correction to the right.

As a result, the design of the cellular omni wheels 200 allows the platform 104 to be constructed to any desired dimension. In addition, the multi-directional rotation and positioning of the omni wheels $\mathbf{202}_1$-$\mathbf{202}_3$ of each of the cellular omni wheels 200 allows registration system 102 to be simplified. For example, a laterally moving carriage may be removed and various nips may be removed. In addition, the distribution of the omni wheels 202 across the platform 104 may allow registration system 102 to handle print media 116 of any dimensions or lengths.

Figure 5:
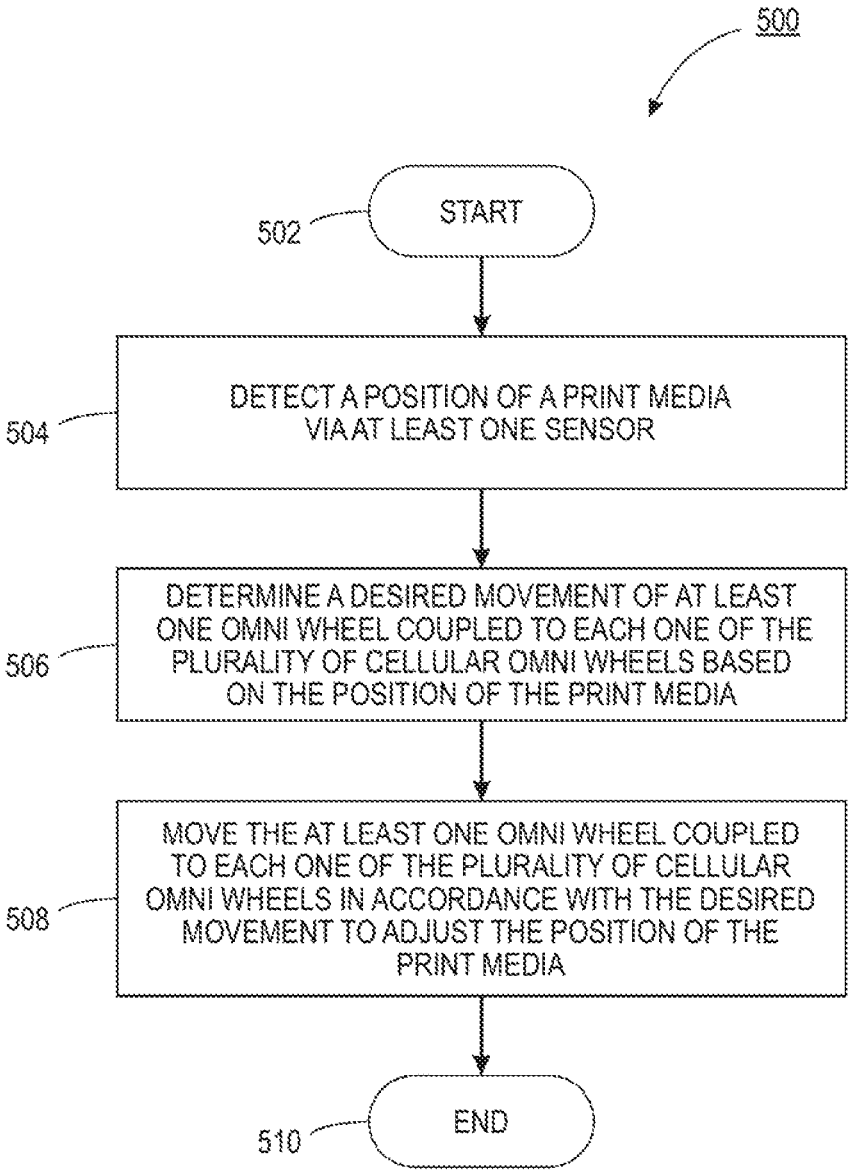
FIG. 5 illustrates a flowchart of an example method for controlling a position of a print media in a registration system of a printing device via a platform of a plurality of cellular omni wheels.
Figure 6:
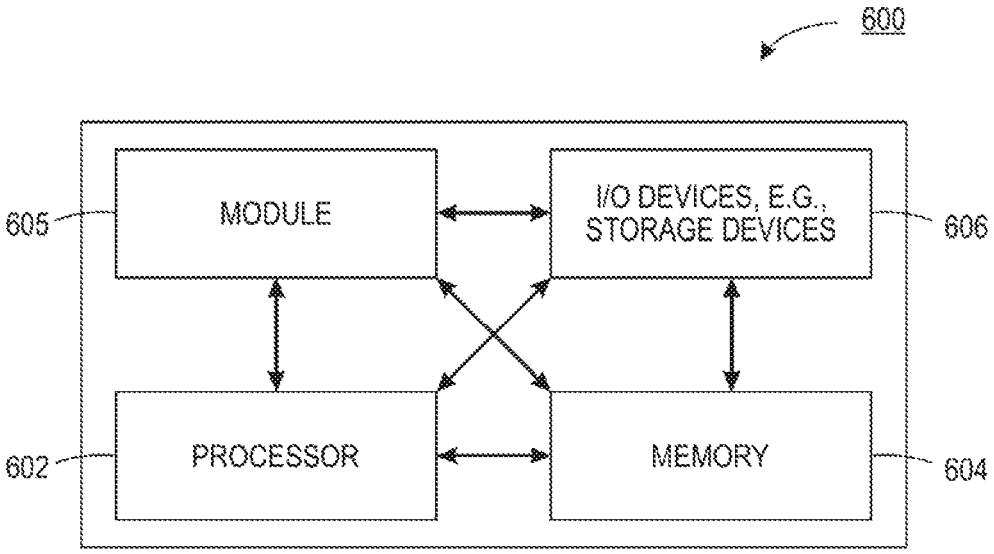
FIG. 6 illustrates a high-level block diagram of an example computer suitable for use in performing the functions described herein.

FIG. 5 illustrates a flowchart of an example method 500 for controlling a position of a print media in a registration system of a printing device via a platform of a plurality of cellular omni wheels. In one embodiment, one or more steps or operations of the method 500 may be performed by the registration system 102, or a computer/processor that controls operation of the registration system 102 as illustrated in FIG. 6 and discussed below.

At block 502, the method 500 begins. At block 504, the method 500 detects a position of a print media via at least one sensor. In one embodiment, the print media may be any type of paper.

In one embodiment, the at least one sensor may be any type of sensor, such as a CCD sensor, a capacitive sensor, a resistive sensor, an image based sensor, and the like. In one embodiment, the position may be a skew and/or a lateral position of the print media.

The skew may be an angle that the print media is tilted off of a straight line in the process direction. The lateral position may measure an amount that the print media is laterally away from a desired alignment position. For example, for a center registered system, the lateral position may include an amount and a direction (e.g., inboard or outboard) that the print media is off-center. For an edge registered system, the lateral position may include an amount of lateral movement away from the alignment edge.

At block 506, the method 500 determines a desired movement of at least one omni wheel coupled to each one of the plurality of cellular omni wheels based on the position of the print media. In one embodiment, the position of the print media may be used to determine the desired movement. For example, the print media may be laterally positioned 0.5 millimeters (mm) off of the registration edge and have a skew angle of 2 degrees towards the outboard side. The method 500 may determine the desired movement to adjust a position of the print media to move laterally towards the registration edge by 0.5 mm and adjust the skew angle back to 0 degrees.

In one embodiment, the desired movement of the omni wheel of the plurality of cellular omni wheels may include a rotational speed of the omni wheel. The omni wheels that are activated and the amount of rotational speed of the activated omni wheels may be based on the amount of movement needed to adjust the skew and the lateral position by a desired amount.

At block 508, the method 500 moves the at least one omni wheel coupled to the each one of the plurality of cellular omni wheels in accordance with the desired movement to adjust the position of the print media. As discussed above, certain omni wheels of each one of the cellular omni wheels may rotate to move the print media in a certain direction. For example, one omni wheel may move the print media in the process direction, one omni wheel may move the print media laterally in one direction, another omni wheel may move the print media laterally in a second direction, a combination of omni wheels at different rotational speeds may rotate the print media to adjust the skew of the print media, or simultaneously adjust the lateral position and the skew of the print media, and the like.

In one embodiment, the omni wheel on the same side, or oriented in the same direction, for each one of the cellular omni wheels may be activated together and rotated at the same speed. In one embodiment, the omni wheel of a subset of the cellular omni wheels may be activated together and rotated at the same speed. The subset may include rows of the cellular omni wheels as the print media travels over the platform of cellular omni wheels. The subset may also include a cluster of omni wheels at a particular location of the print media.

In one embodiment, multiple omni wheels of the cellular omni wheels maybe activated at the same time. The omni wheels in the same orientation may be activated at the same speed or different speeds as the other omni wheels that are also activated. In other words, each omni wheel of each one of the cellular omni wheels may be independently controlled (e.g., together or in different groups) to rotate at a desired speed of rotation to adjust the skew and/or lateral position of the print media.

As a result, the platform of a plurality of cellular omni wheels of the present disclosure may provide a more efficient design for handling print media within the registration system of a printing device. For example, the omni wheels may be deployed and configured to correct both skew and lateral position of the print media. The cellular omni wheels may be arranged to form the platform capable of handling any size print media. At block 510, the method 500 ends.

It should be noted that the blocks in FIG. 5 that recite a determining operation or involve a decision do not necessarily require that both branches of the determining operation be practiced. In other words, one of the branches of the determining operation can be deemed as an optional step. In addition, one or more steps, blocks, functions or operations of the above described method 500 may comprise optional steps, or can be combined, separated, and/or performed in a different order from that described above, without departing from the example embodiments of the present disclosure.

FIG. 6 depicts a high-level block diagram of a computer that is dedicated to perform the functions described herein. As depicted in FIG. 6, the computer 600 comprises one or more hardware processor elements 602 (e.g., a central processing unit (CPU), a microprocessor, or a multi-core processor), a memory 604, e.g., random access memory (RAM) and/or read only memory (ROM), a module 605 for controlling a position of a print media in a registration system of a printing device via a platform of a plurality of cellular omni wheels, and various input/output devices 606 (e.g., storage devices, including but not limited to, a tape drive, a floppy drive, a hard disk drive or a compact disk drive, a receiver, a transmitter, a speaker, a display, a speech synthesizer, an output port, an input port and a user input device (such as a keyboard, a keypad, a mouse, a microphone and the like)). Although only one processor element is shown, it should be noted that the computer may employ a plurality of processor elements.

It should be noted that the present disclosure can be implemented in software and/or in a combination of software and hardware deployed on a hardware device, a computer or any other hardware equivalents (e.g., the registration system 102). For example, computer readable instructions pertaining to the method(s) discussed above can be used to configure a hardware processor to perform the steps, functions and/or operations of the above disclosed methods. In one embodiment, instructions and data for the present module or process 605 for controlling a position of a print media in a registration system of a printing device via a platform of a plurality of cellular omni wheels (e.g., a software program comprising computer-executable instructions) can be loaded into memory 604 and executed by hardware processor element 602 to implement the steps, functions or operations as discussed above in connection with the example method 500. Furthermore, when a hardware processor executes instructions to perform "operations," this could include the hardware processor performing the operations directly and/or facilitating, directing, or cooperating with another hardware device or component (e.g., a co-processor and the like) to perform the operations.

The processor executing the computer readable or software instructions relating to the above described method(s) can be perceived as a programmed processor or a specialized processor. As such, the present module 605 for controlling a position of a print media in a registration system of a printing device via a platform of a plurality of cellular omni wheels (including associated data structures) of the present disclosure can be stored on a tangible or physical (broadly non-transitory) computer-readable storage device or medium, e.g., volatile memory, non-volatile memory, ROM memory, RAM memory, magnetic or optical drive, device or diskette and the like. More specifically, the computer-readable storage device may comprise any physical devices that provide the ability to store information such as data and/or instructions to be accessed by a processor or a computing device such as a computer or an application server.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A registration system for a printing device, comprising:
at least one sensor to detect a position of a print media;
a platform comprising a plurality of cellular omni wheels, wherein each one of the plurality of cellular omni wheels, comprises:
a body portion comprising a flat top surface and a bottom surface, wherein the body portion comprises a hexagonal shape;
a plurality of omni wheels coupled to the bottom surface of the body portion, wherein each one of the plurality of omni wheels comprises:
a central body portion that rotates around a respective center axis of rotation; and
a plurality of roller components coupled to an outer periphery of the central body portion, wherein each one of the plurality of roller components rotate around an axis that is perpendicular to the respective center axis of rotation, wherein the body portion comprise a cut-out along an outer perimeter for each one of the plurality of omni wheels to allow a portion of the each one of the plurality of omni wheels to be above the flat top surface, wherein the cut-out is located on every other edge of the hexagonal shape; and
a motor coupled to each one of the plurality of omni wheels coupled to the bottom surface of the body portion; and
a processor communicatively coupled to the at least one sensor and the plurality of cellular omni wheels, wherein the processor calculates a desired movement of each one of the plurality of cellular omni wheels based on the position of the print media.

2. The registration system of claim 1, wherein the at least one sensor is located upstream from the platform.

3. The registration system of claim 1, further comprising:
a transport nip downstream from the platform to transport the print media after the position of the print media is adjusted by the plurality of cellular omni wheels.

4. The registration system of claim 1, further comprising:
a plurality of idler rollers located opposite the platform.

5. The registration system of claim 1, wherein the plurality of omni wheels comprises three omni wheels arranged symmetrically around the bottom surface of the body portion aligned with a respective cut-out.

6. The registration system of claim 1, wherein the body portion comprises a plurality of connection edges.

7. The registration system of claim 6, wherein the plurality of cellular omni wheels are connected via the plurality of connection edges to form the platform.

8. The registration system of claim 1, wherein one of the plurality of omni wheels of the each one of the plurality of cellular omni wheels is aligned in a process direction.

9. The registration system of claim 1, wherein the desired movement comprises a speed of rotation of each one of the plurality of omni wheels.

10. A registration system for a printing device, comprising:
at least one sensor to detect a position of a print media;
a platform comprising a plurality of cellular omni wheels, wherein each one of the cellular omni wheels comprises:
a hexagonal body portion comprising a flat top surface and a bottom surface, wherein hexagonal body portion comprises alternating edges of a cut-out portion and a connection edge, wherein each one of the plurality of cellular omni wheels are connected to each other by the connection edge;
a plurality of omni wheels coupled to the bottom surface of the body portion and spaced 120 degrees apart around the outer edge of the hexagonal body portion in respective cut-out portions of the hexagonal body, wherein a portion of each one of the plurality of omni wheels is located above the flat top surface of the hexagonal body portion, wherein one of the plurality of omni wheels is aligned in a process direction; and
a motor coupled to the each one of the plurality of omni wheels and coupled to the bottom surface of the hexagonal body portion;
a processor communicatively coupled to the at least one sensor and the plurality of cellular omni wheels, wherein the processor calculates a desired movement of each one of the plurality of omni wheels of the each one of the plurality of cellular omni wheels based on the position of the print media.

* * * * *